United States Patent [19]

Nesbitt

[11] 4,431,193

[45] Feb. 14, 1984

[54] GOLF BALL AND METHOD OF MAKING SAME

[75] Inventor: R. Dennis Nesbitt, Westfield, Mass.

[73] Assignee: Questor Corporation, Tampa, Fla.

[21] Appl. No.: 296,146

[22] Filed: Aug. 25, 1981

[51] Int. Cl.[3] ..... A63B 37/12

[52] U.S. Cl. ..... 273/235 R; 273/218; 273/DIG. 22

[58] Field of Search ..... 273/235 R, 225, 218, 273/214, 217, DIG. 8, DIG. 22

[56] References Cited

U.S. PATENT DOCUMENTS

| | | | |
|---|---|---|---|
| 701,741 | 6/1902 | Kempshall | 273/214 |
| 3,177,280 | 4/1965 | Ford et al. | 273/235 R X |
| 4,272,079 | 6/1981 | Nakade et al. | 273/235 R X |
| 4,274,637 | 6/1981 | Molitor | 273/DIG. 8 X |

*Primary Examiner*—George J. Marlo

*Attorney, Agent, or Firm*—Harry O. Ernsberger; Donald R. Bahr

[57] ABSTRACT

The disclosure embraces a golf ball and method of making same wherein the golf ball has a solid (not thread-wound) resilient center or core, and a multilayer cover construction which involves a first layer or ply of molded hard, high flexural modulus resinous material on the core, and a second or cover layer of soft, low flexural modulus resinous material molded over the first layer to form a finished golf ball. The first layer is of a thickness in a range of 0.020 inches and 0.070 inches and may be of resinous material such as Type 1605 Surlyn marketed by E. I. du Pont de Nemours and Company, and the second or cover layer is of a thickness in a range of 0.020 inches and 0.100 inches and may be of resinous material such as Type 1855 Surlyn marketed by E. I. du Pont de Nemours and Company. Foamable materials for producing a cellular first layer or cellular cover layer are polymeric materials such as ionomer resins.

13 Claims, 2 Drawing Figures

GOLF BALL AND METHOD OF MAKING SAME

TECHNICAL FIELD

The invention relates to a golf ball and more particularly to a cover construction for a golf ball.

BACKGROUND ART

Golf balls having a cover material marketed under the trademark "Surlyn" by E. I. du Pont de Nemours and Company of Wilmington, Del., are known in the art and such cover compositions generally comprise a copolymer of an olefin and at least one unsaturated monocarboxylic acid. Conventional two-piece golf balls are comprised of a solid resilient center or core with molded Surlyn covers. The cover used is normally a hard, high flexural modulus Surlyn resin in order to produce a gain in the coefficient of restitution over that of the center or core.

In a conventional two-piece golf ball, a hard, high flexural modulus Surlyn resin is molded over a resilient center or core. The hard, highly flexural modulus Surlyn resin for the cover of a two-piece golf ball is desirable as it develops the greatest hoop stress and consequently the greatest coefficient of restitution.

A two-piece golf ball having a hard, Surlyn resin cover however does not have the "feel" or playing characteristics associated with softer balata covered golf balls. Heretofore balata covered golf balls have been preferred by most golf professionals. If a golf ball has a cover of soft, low flexural modulus Surlyn resin molded directly over a center or core, it is found that little or no gain in coefficient of restitution is obtained.

DISCLOSURE OF THE INVENTION

In accordance with the present invention there is provided a golf ball having a multilayer or two-ply cover construction for a solid resilient center or core wherein the multilayer cover construction involves two stage molded cover compositions over a solid center or core of resilient polymeric material wherein an increased coefficient of restitution is attained and wherein the "feel" or playing characteristics are attained similar to those derived from a balata covered golf ball.

The invention embraces a golf ball and method of making same wherein the ball has a solid center or core of resilient polymeric or similar material covered by a first layer or ply of molded hard, highly flexural modulus resinous material or of cellular or foam composition which has a high coefficient of restitution.

The first layer or ply is provided with a second or cover layer of a comparatively soft, low flexural modulus resinous material or of cellular or foam composition molded over the first layer and core or center assembly. Such golf ball has the "feel" and playing characteristics simulating those of a softer balata covered golf ball.

Through the use of the first ply or layer of hard, high flexural modulus resinous material on the core or center, a maximum coefficient of restitution may be attained. The resinous material for the first ply or layer may be one type of Surlyn marketed by E. I. du Pont de Nemours and Company of Wilmington, Del., and the other ply or cover layer may be of a different type of Surlyn resin also marketed by the same company.

The three-piece golf ball of the invention provides a golf ball in which the coefficient of restitution of the golf ball closely approaches or attains that which provides the maximum initial velocity permitted by the United States Golf Association Rules of two hundred fifty feet per second with a maximum tolerance of two percent, which velocity may be readily attained and the playing characteristics or "feel" associated with a balata covered ball secured while maintaining a total weight of the golf ball not exceeding 1.620 ounces without sacrificing any advantages of a golf ball having a standard Surlyn cover of the prior art or a golf ball having a softer balata cover.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawings.

BRIEF DESCRIPTION OF THE DRAWINGS

The details of the invention will be described in connection with the accompanying drawings in which.

BEST MODE FOR CARRYING OUT THE INVENTION

Figure 1:
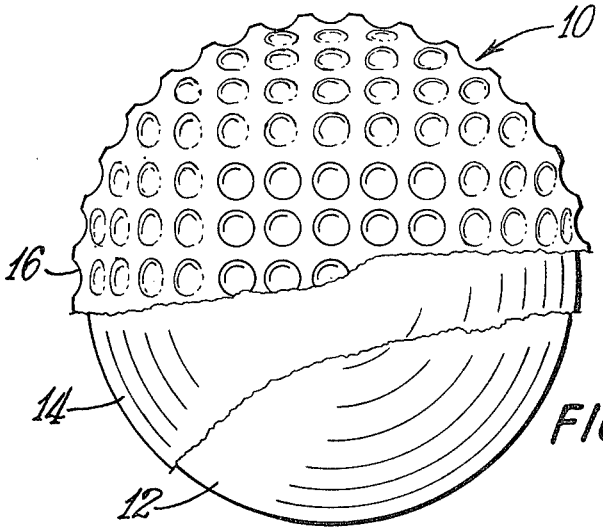
FIG. 1 is a view of a golf ball embodying the invention illustrating portions of the multiply or multilayer cover construction on a core or center.
Figure 2:
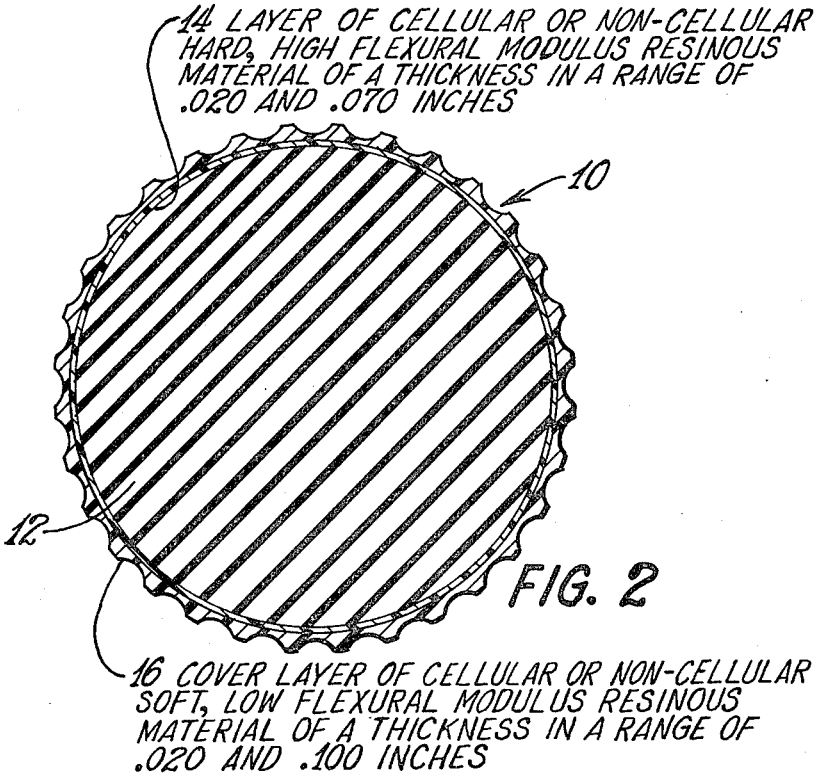
FIG. 2 is a diametrical cross sectional view of the golf ball of the invention.

Referring to the drawings in detail there is illustrated a golf ball 10 which comprises a solid center or core 12 formed as a solid body of resilient polymeric material or rubber-like material in the shape of a sphere. Disposed on the spherical center or core 12 is a first layer, lamination, ply or inner cover 14 of molded hard, highly flexural modulus resinous material such as type 1605 Surlyn marketed by E. I. du Pont de Nemours and Company, Wilmington, Del.

This material of the inner layer 14 being a hard, high flexural modulus resin produces a substantial gain of coefficient of restitution over the coefficient of restitution of the core or center. An outer layer, ply, lamination or cover 16 of comparatively soft, low flexural modulus resinous material such as type 1855 Surlyn marketed by E. I. du Pont de Nemours and Company is then re-molded onto the inner ply or layer 14, the outer surface of the outer layer or cover 16 being of dimpled configuration providing a finished three-piece golf ball.

According to the United States Golf Association Rules, the minimum diameter prescribed for a golf ball is 1.680 inches and the maximum weight prescribed for a golf ball is 1.620 ounces. It is therefore desirable to produce a golf ball having an improved coefficient of restitution to attain an initial velocity for the golf ball approaching the maximum velocity limit of 255 feet per second, the maximum limit provided by the United States Golf Association Rules.

The hard, high flexural modulus resin is employed to increase the coefficient of restitution in order to attain or approach the maximum initial velocity for the golf ball. The use of a soft low flexural modulus resin provides little or no gain in the coefficient of restitution and may tend to reduce the coefficient of restitution thereby adversely affecting the initial velocity factor.

In producing the golf ball of the invention, the density of the center or core may be varied and the relative thicknesses of the layers, plies or laminations 14 and 16 may be varied within limits so that the golf ball weight does not exceed 1.620 ounces, the minimum diameter not less than 1.680 inches, and the ball be capable of an initial velocity approaching 255 feet per second. However, the finished golf ball may be of larger diameter providing the total weight of the ball does not exceed 1.620 ounces.

Thus, by varying the density of the center or core 12 and varying the thicknesses of the plies or layers 14 and 16 of the cover construction, a golf ball may be produced having a total weight not exceeding 1.620 ounces and a minimum diameter of 1.680 inches and having a comparatively high coefficient of restitution, the ball closely approaching or attaining in play the maximum permitted initial velocity of 255 feet per second.

In the golf ball of the invention the thickness of the inner layer or ply 14 and the thickness of the outer layer or ply 16 may be varied to secure the advantages herein mentioned. It is found that the inner layer 14 of hard, high flexural modulus resinous material, such as Surlyn resin type 1605, is preferably of a thickness in a range of 0.020 inches and 0.070 inches. The thickness of the outer layer or cover 16 of soft, low flexural modulus resin, such as Surlyn type 1855, may be in a range of 0.020 inches and 0.100 inches.

For example, a center or core 12 having a 0.770 coefficient of restitution is molded with a layer of hard, high modulus Surlyn resin, such as Surlyn type 1605, to form a spherical body of a diameter of about 1.565 inches. This spherical body comprising the core or center 12 and layer 14 of the hard, high modulus Surlyn resin has a coefficient of restitution of 0.800 or more.

This center or core 12 and inner layer 14 of hard resinous material in the form of a sphere is then remolded into a dimpled golf ball of a diameter of 1.680 inches minimum with an outer or cover layer 16 of a soft, low flexural modulus resin such as Surlyn type 1855. The outer layer of the soft resin is of a thickness of 0.0575 inches. The soft Surlyn resin cover would have about the same thickness and shore hardness of a balata covered golf ball and would have the advantageous "feel" and playing characteristics of a balata covered golf ball.

It is to be understood that the golf ball of the invention may be made of a diameter greater than 1.680 inches without exceeding the total weight of 1.620 ounces by varying the thickness of the inner layer or ply 14 and the outer cover layer or ply 16 and secure desired "feel" and playing characteristics.

The inner, intermediate, or first layer or ply 14 and the outer cover, second layer or ply 16 or either of the layers may be cellular when formed of a foamed natural or synthetic polymeric material. Polymeric materials are preferably such as ionomer resins which are foamable. Reference is made to the application Ser. No. 155,658, of Robert P. Molitor issued into U.S. Pat. No. 4,274,637 which describes a number of foamable compositions of a character which may be employed for one or both layers 14 and 16 for the golf ball of this invention.

The inner, intermediate or first layer 14 on the core 12 may be preferably partially or only slightly foamed to a low degree so as not to materially affect the coefficient of restitution of the material. The outer or cover layer or second layer 16 may be foamed to a greater degree than the inner, intermediate or first layer 14 as the material of the layer 16 is comparatively soft.

The inner, intermediate or first layer 14 may be unfoamed or noncellular and the outer layer may be cellular or foamed resin. If certain characteristics are desired for the golf ball, the inner layer 14 may be slightly or partially foamed and the outer or cover layer or ply 16 may be of unfoamed or noncellular material.

Through the use of foamable material for the first layer, the cover layer or both layers, the degree of foaming of one or the other or both layers may be altered to provide a variation in the coefficient of restitution of the golf ball.

It is apparent that, within the scope of the invention, modifications and different arrangements may be made other than as herein disclosed, and the present disclosure is illustrative merely, the invention comprehending all variations thereof.

I claim:

1. A golf ball comprising a spherically-shaped solid core of resilient material, a first layer of hard, high flexural modulus ionomer resin molded onto the core, and a cover layer of soft, low flexural modulus ionomer resin molded over the first layer of ionomer resin on the core, the total weight of the golf ball not exceeding 1.620 ounces.

2. A golf ball comprising a spherically-shaped solid core of resilient polymeric material, a first layer of hard, high flexural modulus ionomer resin molded onto the core, and a second layer of soft, low flexural modulus ionomer resin molded over the first layer of ionomer resin on the core, the total weight of the golf ball not exceeding 1.620 ounces.

3. A golf ball comprising a spherically-shaped solid core of resilient polymeric material, a layer of comparatively hard, high flexural modulus ionomer resin molded onto the core, the exterior surface of the layer being of spherical configuration, and a cover layer of comparatively soft, low flexural modulus ionomer resin molded over the layer of hard, high flexural modulus ionomer resin, the outer surface of the cover layer being of dimpled configuration, the total weight of the golf ball not exceeding 1.620 ounces.

4. A golf ball comprising a spherically-shaped solid core of resilient material, a hard, high flexural modulus ionomer resin molded onto the core forming a layer on the core, a soft, low flexural modulus ionomer resin molded over the layer of high flexural modulus ionomer resin providing a cover layer of generally spherical shape, the exterior surface of said cover layer being of dimpled configuration, the total weight of the golf ball not exceeding 1.620 ounces, and the diameter of the golf ball being not less than 1.680 inches.

5. A golf ball according to claim 4 wherein the layer of hard, high flexural modulus ionomer resin is of a thickness in a range of 0.020 inches and 0.070 inches.

6. A golf ball according to claim 4 wherein the cover layer of soft, low flexural modulus ionomer resin is of a thickness in a range of 0.020 inches and 0.100 inches.

7. A three-piece golf ball comprising a spherically-shaped solid core of resilient material, a comparatively hard, high flexural modulus ionomer resin molded onto the core forming a layer of the hard, high flexural modulus ionomer resin on the core, and a comparatively soft, low flexural modulus ionomer resin molded onto the layer of hard, high flexural modulus ionomer resin forming a cover layer, the exterior surface of the cover layer being a dimpled configuration and generally of spherical shape, the total weight of the golf ball not exceeding 1.620 ounces, and the diameter of the golf ball being not less than 1.680 inches.

8. A three-piece golf ball comprising a spherically-shaped solid core of resilient material, a hard, high flexural modulus surlyn resin molded onto the core forming a first layer of spherical configuration on the core, a soft, low flexural modulus SURLYN resin molded over the first layer of hard, high flexural modulus SURLYN resin to form a cover layer of spherical configuration, the exterior surface of the cover layer being of dimpled configuration, and the total weight of the golf ball not exceeding 1.620 ounces.

9. A golf ball comprising a spherically-shaped solid core of resilient material, a first layer of hard, high flexural modulus ionomer resin molded onto the core, and a cover layer of soft, low flexural modulus foamable ionomer resin molded over the first layer of ionomer resin on the core, said cover layer being foamed to a cellular condition, the total weight of the ball not exceeding 1.620 ounces.

10. A golf ball comprising a spherically-shaped solid core of resilient material, a first layer of hard, high flexural modulus foamable ionomer resin molded onto the core, said first layer being foamed to a cellular condition, and a cover layer of soft, low flexural modulus ionomer resin molded over the first layer of foamable ionomer resin on the core, the total weight of the ball not exceeding 1.620 ounces.

11. A golf ball comprising a spherically-molded solid core of resilient material, a first layer of hard, high flexural modulus foamable ionomer resin molded onto the core, said first layer being foamed to a cellular condition, and a cover layer of soft, low flexural modulus foamable ionomer resin molded over the first layer of ionomer resin, said cover layer being foamed to a cellular condition, the total weight of the ball not exceeding 1.620 ounces.

12. The method of producing a three-piece golf ball including providing a solid core of resilient material of spherical configuration, molding onto the core a hard, high flexural modulus ionomer resin providing a first layer on the core, molding a soft, low flexural modulus ionomer resin onto the first layer providing a cover layer of spherical shaped wherein the total weight of the golf ball does not exceed 1.620 ounces and the ball being of a diameter not less than 1.680 inches.

13. The method of producing a three-piece golf ball including providing a solid core of resilient polymeric material of spherical configuration, molding onto the core a hard, high flexural modulus SURLYN resin providing a first layer on the core, molding a soft, low flexural modulus Surlyn resin onto the first layer providing a cover layer of spherical shape wherein the total weight of the golf ball does not exceed 1.620 ounces and the ball being of a diameter not less than 1.680 inches.

* * * * *